US007874425B2

(12) United States Patent
Quartarone, III et al.

(10) Patent No.: US 7,874,425 B2
(45) **Date of Patent: *Jan. 25, 2011**

(54) GOLF BAG STAND

(75) Inventors: Frank A. Quartarone, III, Phoenix, AZ (US); Brian J. McGuire, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/703,677

(22) Filed: Feb. 10, 2010

(65) Prior Publication Data

US 2010/0140122 A1 Jun. 10, 2010

Related U.S. Application Data

(63) Continuation of application No. 11/848,920, filed on Aug. 31, 2007, now Pat. No. 7,686,164.

(60) Provisional application No. 60/884,670, filed on Jan. 12, 2007.

(51) Int. Cl.
*A63B 55/06* (2006.01)

(52) U.S. Cl. ..... 206/315.7; 248/96

(58) Field of Classification Search ..... 206/315.7, 206/315.8, 315.3; 248/95–98
See application file for complete search history.

(56) References Cited

U.S. PATENT DOCUMENTS

| | | | | |
|---|---|---|---|---|
| 1,975,702 | A * | 10/1934 | Sterling | 248/96 |
| 2,663,528 | A * | 12/1953 | Hadley | 248/96 |
| 4,488,697 | A * | 12/1984 | Garvey | 248/101 |
| 4,834,235 | A * | 5/1989 | Solheim et al. | 206/315.7 |
| 4,921,192 | A * | 5/1990 | Jones | 248/96 |
| 6,325,208 | B1 * | 12/2001 | Cheng | 206/315.7 |
| 7,686,164 | B2 * | 3/2010 | Quartarone et al. | 206/315.7 |

FOREIGN PATENT DOCUMENTS

GB 2098075 A * 11/1982

* cited by examiner

*Primary Examiner*—Sue A Weaver

(57) ABSTRACT

A golf bag has an extensible stand which incorporates legs having a compound bend. The legs provide increased stability when deployed, without increasing the splay angle of the leg pivots. The compound bend in the legs also permits the legs to fold compactly against the golf bag body.

20 Claims, 3 Drawing Sheets

GOLF BAG STAND

This is a continuation application of application Ser. No. 11/848,920 filed Aug. 31, 2007, claiming benefit of provisional application No. 60/884,670 filed Jan. 12, 2007, now U.S. Pat. No. 7,686,164.

BACKGROUND OF THE INVENTION

This invention relates to golf equipment and, in particular, to golf bags with stands.

Golf bags with stands are well known in the art. One popular golf bag with a stand is disclosed in U.S. Pat. No. 4,834,235 to Solheim et al. The golf bag disclosed in the Solheim patent comprises a lightweight fabric body with rigid members at the top and bottom ends. The rigid members are connected by a rigid spine that extends longitudinally of the body. Because the spine supports only one side of the body, the diametrically opposed side of the body remains at least partially collapsible. It is this characteristic that is employed to operate the golf bag stand which is mounted on the partially collapsible side of the body and includes a pair of legs. The upper ends of the legs are pivotally attached to the rigid member at the top end of the body. An actuator rod of generally U-shaped configuration is attached to the rigid member at the bottom end of the body so that the free ends of the actuator rod may be attached to the legs at points between the upper and lower ends of the legs.

Whenever the golf bag is in its normal position, i.e., in the form of a right circular cylinder, such as when being carried, the distance between the top and bottom ends of the body will be at a maximum. This causes the legs to be retracted and held firmly against the side of the body so that the legs do not interfere with any normal activities of the golfer carrying the golf bag.

When the golfer sets the golf bag down, the simple and natural movement of resting the golf bag on its bottom end and leaning it over slightly automatically moves the legs of the stand into an extended position as the partially collapsible side of the body collapses. The pivot axes of the legs are approximately tangent to the throat of the golf bag. Accordingly, as the legs deploy they splay outward to provide a more stable tripod than could be accomplished if the pivot axes were parallel. Increasing the separation of the pivots and therefore the splay angle of the legs would increase the stability, however, would reduce the mechanical advantage of the actuator. The longer legs required by an increased splay angle would also potentially extend beyond the bottom of the bag and interfere with the automatic deployment mechanism. Accordingly, it would be advantageous to provide a golf bag with an automatically extensible bag stand having a wider track in its deployed condition without increasing the pivot splay angle or substantially increasing the length of the retracted legs.

SUMMARY OF THE INVENTION

The present invention comprises a golf bag with an extensible stand. According to an illustrative embodiment of the invention, the golf bag comprises a generally tubular body and an extensible stand mounted on the body. The extensible stand incorporates legs having a compound bend that provides increased stability when they are deployed, without increasing the splay angle of the leg pivots. The compound bend also permits the legs to fold around the side of the body thereby enabling the legs to fold more compactly than prior art golf bag stands.

DESCRIPTION

Figure 1:
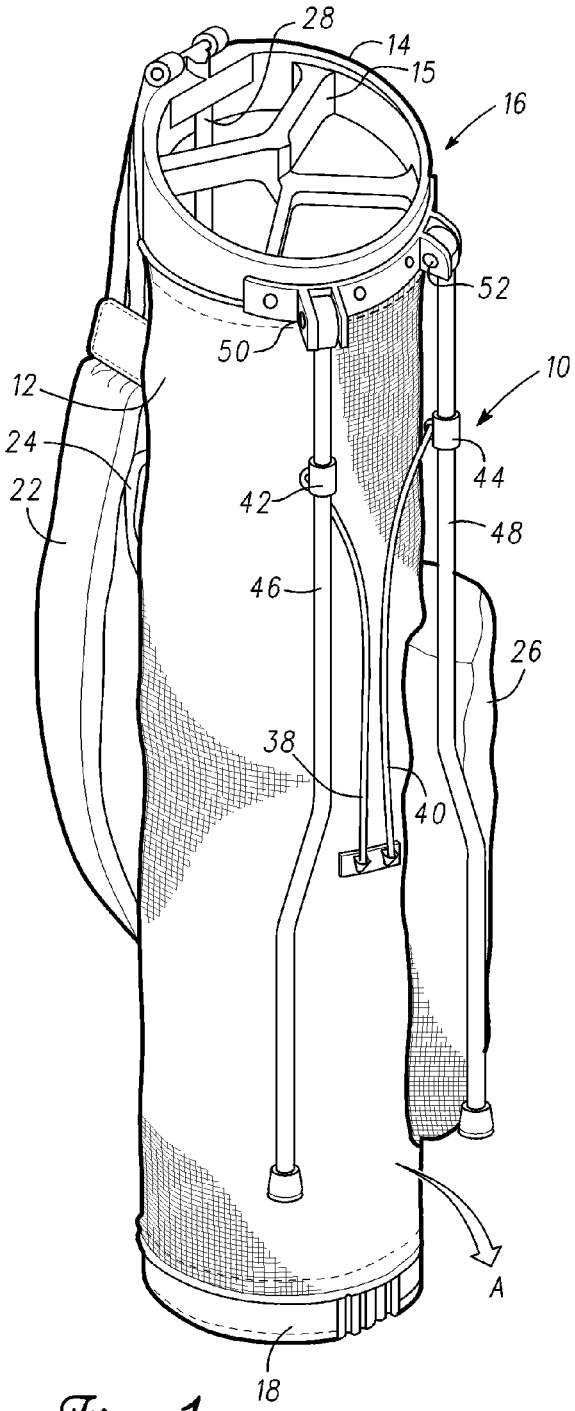
FIG. 1 is a perspective view of a golf bag incorporating features of the present invention.
Figure 2:
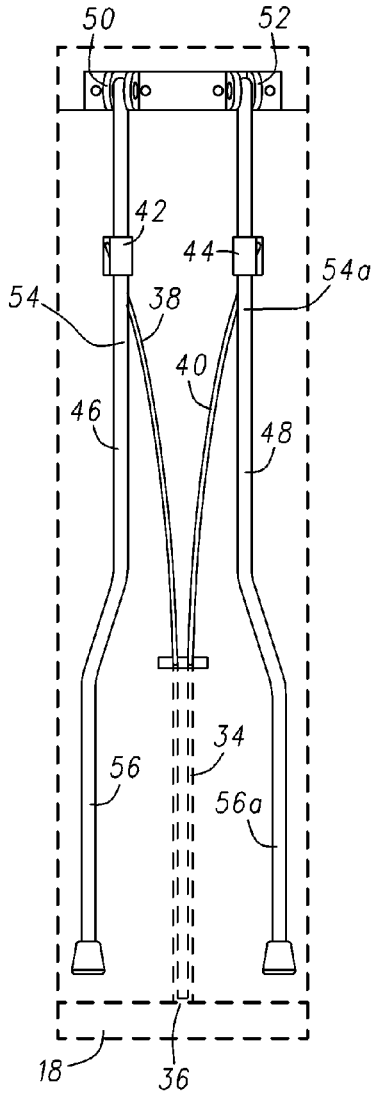
FIG. 2 is a partially diagrammatic view showing the golf bag of FIG. 1 with its stand in a retracted position.
Figure 3:
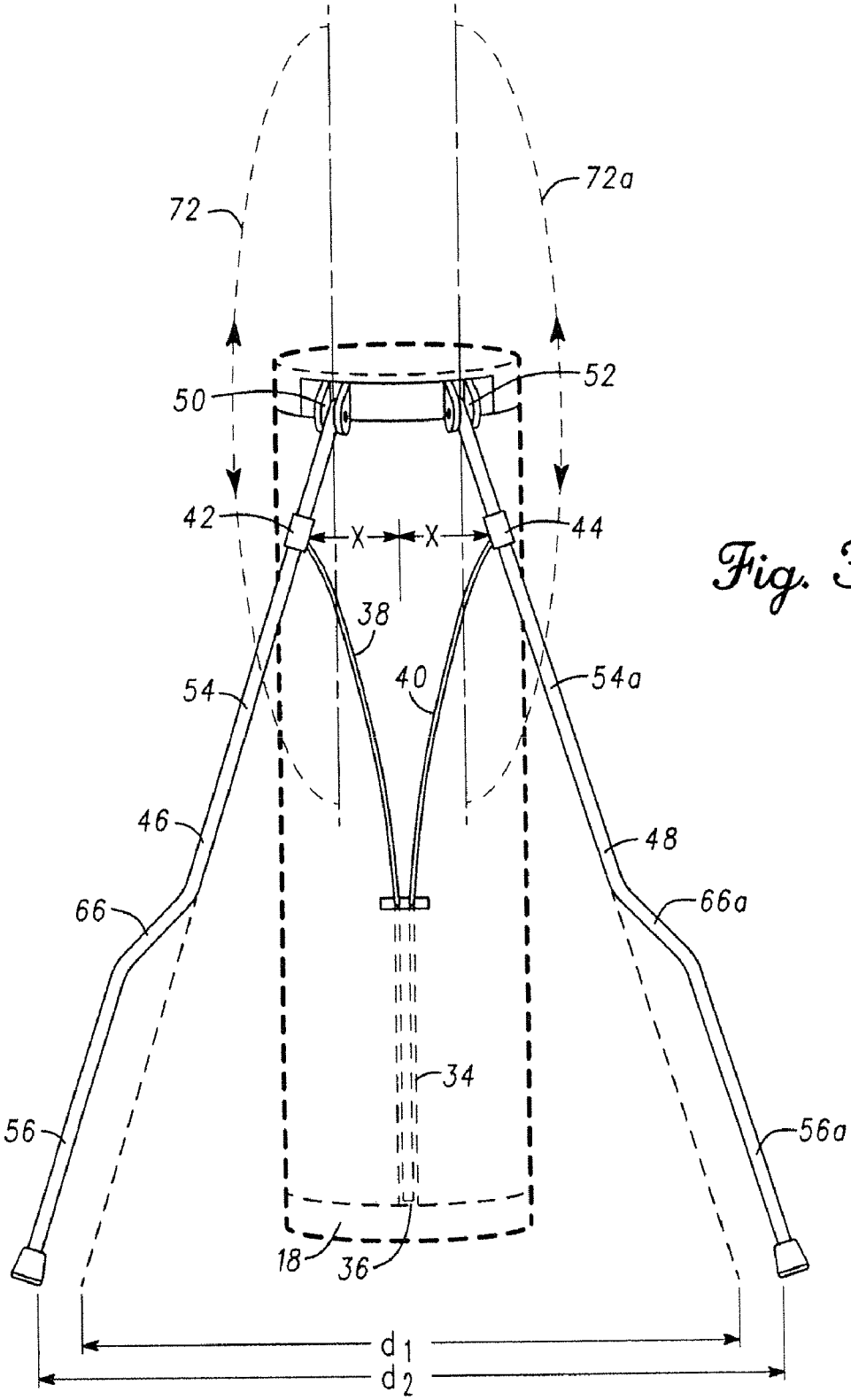
FIG. 3 is a partially diagrammatic view showing the bag of FIG. 1 with its stand in a deployed position.

With reference to FIGS. 1-3, golf bag 10 comprises a generally tubular body 12 that may be formed of nylon or other lightweight fabric. A ring-shaped member such as throat 14 is stitched or otherwise mounted to the top end 16 of body 12. Throat 14 includes a plurality of dividers 15 that segregate golf clubs into predetermined groups, with golf clubs being inserted into and removed from the bag through the throat 14. A rigid bottom 18 is similarly mounted to the bottom end of body 12. Both throat 14 and bottom 18 are preferably molded or otherwise formed of a suitable synthetic resin in a manner well known in the art. Golf bag 10 may also include various other features normally associated with golf bags such as a shoulder strap 22, handle 24 and an accessory pocket 26. A generally rigid spine 28 interconnects throat 14 and bottom 18 to maintain throat 14 and bottom 18 in a spaced-apart relationship. Spine 28 may be made of wood, fiberglass or other suitable rigid lightweight material. Lower end of spine 28 is hingedly attached to bottom 18 by means of a length of fabric or other flexible material forming a fabric hinge which permits bottom 18 to pivot relative to spine 28. As can be determined from the foregoing, because spine 28 extends along only one side of golf bag 10, the side of the body 12 diametrically opposite spine 28 is partially collapsible. Therefore, when placed upright resting on bottom 18, golf bag 10 will tend to collapse toward this collapsible side as indicated by arrow "A" as shown in FIG. 1.

Golf bag 10 further includes an automatically extensible stand with a U-shaped actuator rod 34, the lower end 36 of which is attached to a bearing (not shown) formed in bottom 18. Actuator rod 34 has two upward extending arms 38 and 40. The upper ends of arms 38 and 40 are pivotally attached to collars 42 and 44 formed on legs 46 and 48. Legs 46 and 48 are themselves pivotally attached to hinges or bearings 50 and 52 formed on throat 18.

Figure 4:
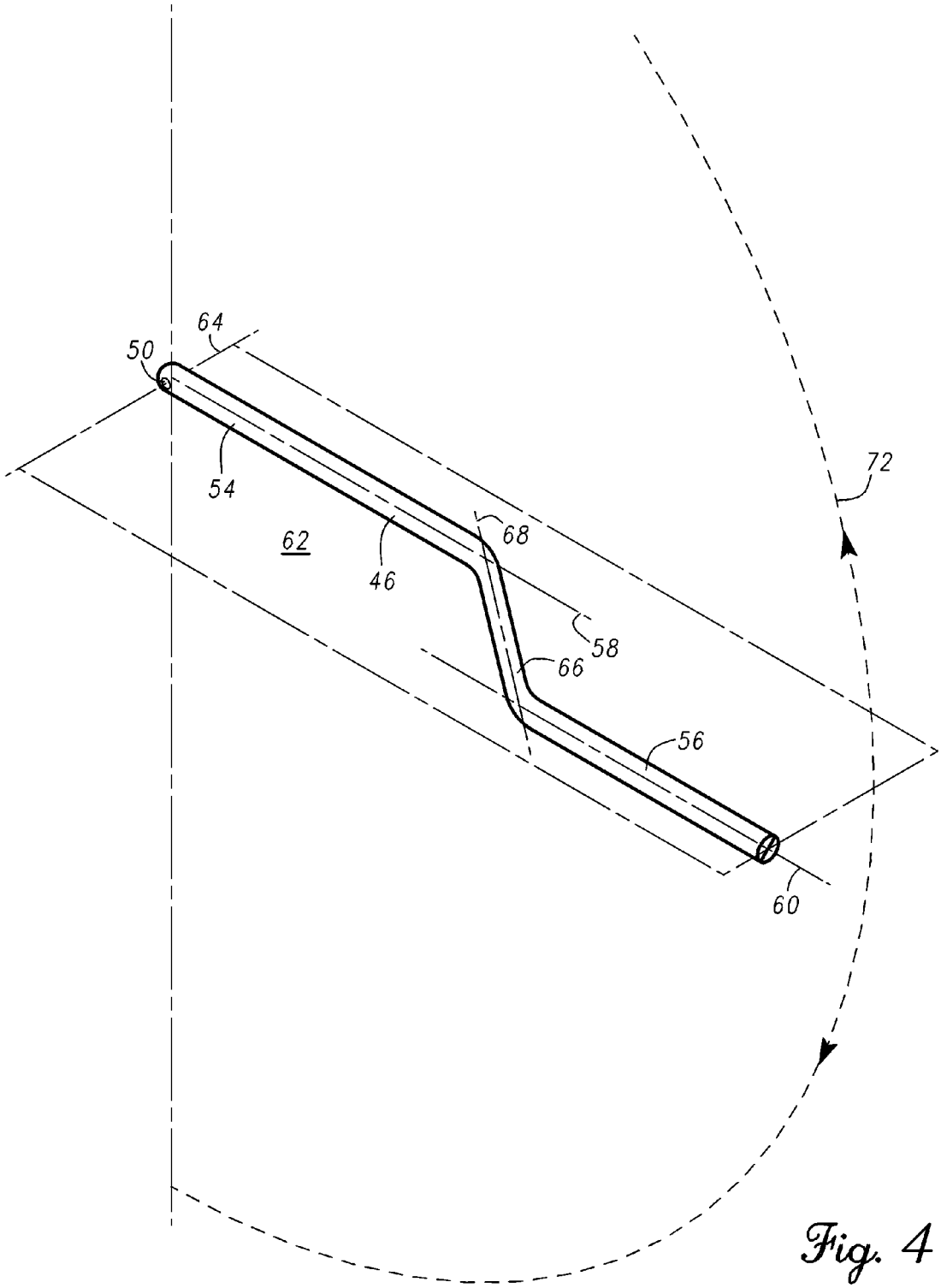
FIG. 4 is a perspective view of a leg member of the stand incorporating features of the present invention.

With additional reference to FIG. 4, leg 46 comprises an upper segment 54, on which the collar 42 is mounted, and a lower segment 56. Upper segment 54 and lower segment 56 have longitudinal axes 58 and 60, respectively, that lie in a plane 62, which also contains the rotational axis 64 of bearing 50. Upper segment 54 and lower segment 56 are rigidly connected by an intermediate segment 66 having a longitudinal axis 68 also lying in plane 62. Since rotational axis 64 of bearing 50 is contained in plane 62, rotational axis 64 also defines a rotational plane 72 that passes through the longitudinal axis 58 of segment 54, perpendicular to plane 62. Since leg 48 is of substantially identical construction as leg 46, it will not be discussed in detail other than to observe that bearing 52 defines a rotational plane **72*a* that passes through the longitudinal axis of upper segment 54*a* perpendicular to a plane containing upper segment 54*a*, lower segment 56*a* and intermediate segment 66*a***.

When golf bag 10 is in a normal position as shown in FIG. 2, such as when it is being carried or held in an upright position, body 12 generally will be cylindrical in shape. In such a state, the action of bottom 18 acting on legs 46 and 48 through actuator rod 34 will cause legs 46 and 48 to fold against the side of body 12 in a retracted position and thus be held out of the way. As shown in FIGS. 1 and 2, because the bend in the legs 46, 48 is coplanar with the plane containing the rotational axes of bearings 50 and 52 (e.g. rotational axis 64), the resulting substantially Z-shaped legs 46, 48 fold partially around the body 12 and out of the way. When golf bag 10 is placed on the ground and tilted slightly forward, the collapsible portion of body 12 collapses and the actuator rod 34 moves the legs 46, 48 into a deployed position.

Bearings 50 and 52 are substantially tangent to throat 14 and, therefore, are non-parallel. Accordingly, as legs 46 and 48 are deployed, they splay outward by a predetermined amount determined by the angle between the axis of bearing 50 and the axis of bearing 52. If legs 46 and 48 were straight, the splay angle would produce a predetermined width d1 as shown in FIG. 3. Because the lower segments 56 and 56*a* are offset radially outward from upper segments 54 and 54*a* relative to the longitudinal axis of body 12, i.e laterally outwards relative to rotational plane 72, the stance of the legs 46, 48 is increased to a distance d2 as shown in FIG. 3. This is accomplished without increasing the offset "x" between the line of action of actuator 34 and legs 46 and 48, which would decrease the mechanical advantage of actuator 34 and possibly cause the stand to bind. Instead, because of the unique shape of legs 46 and 48, their stance is increased for additional stability while maintaining the actuator offset distance "x" within acceptable limits.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf bag comprising:

a body having a generally tubular shape with a top end and a bottom end; and an automatically extensible stand mounted to the body, the automatically extensible stand comprising first and second legs;

each of the first and second legs having an upper segment, an intermediate segment and a lower segment;

each of the upper segments having an upper end pivotally mounted to the body proximal the top end of the body;

each of the lower segments being positioned toward the bottom end of the body and offset laterally outward from a corresponding upper segment;

each of the intermediate segments forming a rigid connection between the upper segment and the lower segment, each of the intermediate segments having at least two non-concentric bends;

the first leg being pivotally mounted to the body by a first hinge defining a first rotational axis and a first rotational plane;

the second leg being pivotally mounted to the body by a second hinge defining a second rotational axis and a second rotational plane, the first and second rotational planes being non-parallel;

the automatically extensible stand further comprising an actuator rod for moving the first and second legs from a retracted position to a deployed position; the actuator rod having a lower end coupled to the bottom end of the body, a first upper end coupled to an intermediate portion of the first leg, and a second upper end coupled to an intermediate portion of the second leg, whereby the actuator operates to move the first and second legs from the retracted position to the deployed position as the body is tilted from a vertical position to a leaning position.

2. The golf bag of claim 1, wherein the upper segment of the first leg is spaced apart from the upper segment of the second leg.

3. The golf bag of claim 1, wherein a longitudinal axis of the upper segment of the first leg and a longitudinal axis of the upper segment of the second leg are substantially parallel in the retracted position and are nonparallel in the deployed position.

4. The golf bag of claim 1, wherein:

the body comprises a flexible fabric sleeve with a generally rigid spine extending along one side of the body between the top end and the bottom end; and the body further comprises a partially collapsible side opposite the generally rigid spine.

5. The golf bag of claim 1, wherein:

a longitudinal axis of the upper segment of the first leg is substantially parallel to a longitudinal axis of the lower segment of the first leg.

6. The golf bag of claim 5, wherein:

a longitudinal axis of the upper segment of the second leg is substantially parallel to a longitudinal axis of the lower segment of the second leg.

7. The golf bag of claim 1, wherein:

the body has a throat comprising a ring-shaped member attached to the top end of the body; and the first and second rotational axes are tangent to the throat.

8. A golf bag comprising:

a body having a generally tubular shape with a top end and a bottom end the body comprising a flexible fabric sleeve with a generally rigid spine extending along one side of the body between the top end and the bottom end and a partially collapsible side opposite the rigid spine;

an automatically extensible stand mounted to the body, the automatically extensible stand comprising first and second legs pivotally attached proximal the top end of the body, each of the first and second legs comprising an elongated substantially Z-shaped member having an upper segment and a lower segment joined together by an intermediate segment such that a longitudinal axis of the upper segment of each of the first and second legs is offset toward the body from a longitudinal axis of a corresponding one of the lower segments of each of the first and second legs;

the first leg being pivotally mounted to the body by a first hinge defining a first rotational axis and a first rotational plane;

the second leg being pivotally mounted to the body by a second hinge defining a second rotational axis and a second rotational plane, the first and second rotational planes being nonparallel;

the automatically extensible stand further comprising an actuator rod having a lower end coupled to the bottom end of the body, a first upper end coupled to an intermediate portion of the first leg and a second upper end coupled to an intermediate portion of the second leg, whereby the actuator operates to deploy the first and second legs as the body is tilted from a vertical position to a leaning position.

9. The golf bag of claim 8, wherein the upper segment of the first leg is spaced apart from the upper segment of the second leg.

10. The golf bag of claim 8, wherein the longitudinal axes of the upper segments of each of the first and second legs are substantially parallel in the retracted position and are nonparallel in the deployed condition.

11. A golf bag comprising:

a body having a top end and a bottom end;

an extensible stand mounted to the body, the extensible stand comprising first and second legs movable from a retracted position to a deployed position;

the first and second legs each having an upper segment, an intermediate segment and a lower segment;

the upper segments each having a longitudinal axis and an upper end pivotally mounted to the body proximal the top end;

the lower segments each having a longitudinal axis, the lower segments each being offset outward from a corresponding first segment;

the intermediate segments each forming a rigid connection between corresponding upper and lower segments;

an actuator rod for moving the first and second legs from a retracted position to a deployed position as the body is tilted from a vertical position to a leaning position, the actuator rod comprising a lower end coupled to the bottom end of the body, a first upper end coupled to an intermediate portion of the first leg and a second upper end coupled to an intermediate portion of the second leg;

wherein the longitudinal axes of the upper segments of the first and second legs are substantially parallel to each other in the retracted position but are not parallel to each other in the deployed position.

12. The golf bag of claim 11, wherein the body has a generally tubular shape.

13. The golf bag of claim 11, wherein the longitudinal axes of the upper segments of the first and second legs splay outward in the deployed position.

14. The golf bag of claim 11, wherein the actuator rod is connected to collars mounted on the upper segments of the first and second legs.

15. The golf bag of claim 11, wherein the first and second legs are each substantially Z-shaped.

16. The golf bag of claim 11, wherein:

the body comprises a flexible fabric sleeve with a generally rigid spine extending along one side of the body between the top end and the bottom end;

the body further comprising a partially collapsible side opposite the rigid spine.

17. The golf bag of claim 11, wherein:

the upper segments are pivotally mounted to a ring-shaped member attached to the top end of the body.

18. The golf bag of claim 11, wherein:

the first and second legs each comprise a single unitary tubular member.

19. The golf bag of claim 11, wherein:

the actuator rod comprises a unitary U-shaped rod member.

20. The golf bag of claim 11, wherein the body has a throat comprising a ring-shaped member attached to the top end of the body, the throat including a plurality of dividers for segregating a plurality of golf clubs into predetermined groups.

* * * * *